US009316368B2

(12) United States Patent
Pickard et al.

(10) Patent No.: US 9,316,368 B2
(45) Date of Patent: Apr. 19, 2016

(54) LED LUMINAIRE INCLUDING A THIN PHOSPHOR LAYER APPLIED TO A REMOTE REFLECTOR

(75) Inventors: Paul Kenneth Pickard, Morrisville, NC (US); Nicholas William Medendorp, Jr., Raleigh, NC (US)

(73) Assignee: Cree, Inc., Durham, NC (US)

( * ) Notice: Subject to any disclaimer, the term of this patent is extended or adjusted under 35 U.S.C. 154(b) by 623 days.

(21) Appl. No.: 13/088,690

(22) Filed: Apr. 18, 2011

(65) Prior Publication Data

US 2012/0262902 A1 Oct. 18, 2012

(51) Int. Cl.

| | |
|---|---|
| ***F21V 9/08*** | (2006.01) |
| ***F21S 8/00*** | (2006.01) |
| ***F21S 8/02*** | (2006.01) |
| ***F21V 7/00*** | (2006.01) |
| ***F21V 7/22*** | (2006.01) |
| *F21Y 101/02* | (2006.01) |
| *F21V 13/04* | (2006.01) |
| *F21V 29/74* | (2015.01) |
| *F21V 29/75* | (2015.01) |
| *F21V 29/77* | (2015.01) |

(52) U.S. Cl.

CPC .. *F21S 8/03* (2013.01); *F21S 8/026* (2013.01); *F21V 7/005* (2013.01); *F21V 7/0008* (2013.01); *F21V 7/22* (2013.01); *F21V 13/04* (2013.01); *F21V 29/745* (2015.01); *F21V 29/75* (2015.01); *F21V 29/777* (2015.01); *F21Y 2101/02* (2013.01); *Y10T 29/49002* (2015.01)

(58) Field of Classification Search

CPC ..... H01L 2224/48091; H01L 2251/5361

USPC ..... 362/84

See application file for complete search history.

(56) References Cited

U.S. PATENT DOCUMENTS

| | | | |
|---|---|---|---|
| 5,688,042 | A | 11/1997 | Madadi et al. |
| 6,350,041 | B1 | 2/2002 | Tarsa et al. |
| 6,853,151 | B2 | 2/2005 | Leong et al. |

(Continued)

FOREIGN PATENT DOCUMENTS

| | | | |
|---|---|---|---|
| JP | H08162677 | A | 6/1996 |
| WO | WO 2008146229 | A2 * | 12/2008 |

(Continued)

OTHER PUBLICATIONS

U.S. Appl. No. 12/873,303, filed Aug. 31, 2010.

(Continued)

*Primary Examiner* — Nimeshkumar Patel
*Assistant Examiner* — Brenitra M Lee
(74) *Attorney, Agent, or Firm* — Steven B. Phillips; Moore & Van Allen PLLC

(57) ABSTRACT

A luminaire including a thin phosphor layer applied to a remote reflector is disclosed. In some embodiments of the luminaire, LEDs illuminate and activate a thin remote phosphor coating applied to a reflective substrate. In some embodiments, the LED light source includes at least one LED with a GaN emitting layer. The LEDs can be packaged with or without a local phosphor. The thin remote phosphor can include red, red/orange, yellow, green or cyan emitting phosphor so that the luminaire produces white light. The thin remote phosphor layer can include two or more different color emitting phosphors. In some embodiments, the luminaire is a light fixture including a diffuser lens assembly and a pan to support the fixture when mounted in a ceiling.

35 Claims, 6 Drawing Sheets

(56) References Cited

U.S. PATENT DOCUMENTS

| | | | | |
|---|---|---|---|---|
| 6,860,628 | B2 | 3/2005 | Robertson et al. | |
| 6,936,968 | B2 | 8/2005 | Cross et al. | |
| 7,029,935 | B2 | 4/2006 | Negley et al. | |
| 7,048,410 | B2 | 5/2006 | Kutler | |
| 7,049,761 | B2 | 5/2006 | Timmermans et al. | |
| 7,114,830 | B2 | 10/2006 | Robertson et al. | |
| 7,213,940 | B1 | 5/2007 | Van De Ven et al. | |
| 7,307,391 | B2 | 12/2007 | Shan | |
| 7,510,299 | B2 | 3/2009 | Timmermans et al. | |
| 7,614,759 | B2 | 11/2009 | Negley | |
| 7,703,945 | B2 | 4/2010 | Leung et al. | |
| 7,768,192 | B2 | 8/2010 | Van De Ven et al. | |
| 7,815,338 | B2 | 10/2010 | Siemiet et al. | |
| 7,926,975 | B2 | 4/2011 | Siemiet et al. | |
| 7,976,196 | B2 | 7/2011 | Ivey et al. | |
| 8,058,659 | B2 | 11/2011 | Bisberg | |
| 8,093,823 | B1 | 1/2012 | Ivey et al. | |
| 8,115,411 | B2 | 2/2012 | Shan | |
| 8,118,447 | B2 | 2/2012 | Simon et al. | |
| 8,247,985 | B2 | 8/2012 | Timmermans et al. | |
| 8,282,247 | B2 | 10/2012 | Ivey et al. | |
| 8,324,817 | B2 | 12/2012 | Ivey et al. | |
| 8,360,599 | B2 | 1/2013 | Ivey et al. | |
| 8,362,710 | B2 | 1/2013 | Langovsky | |
| 8,382,327 | B2 | 2/2013 | Timmermans et al. | |
| 8,419,223 | B2 | 4/2013 | Withers | |
| 8,421,366 | B2 | 4/2013 | Palazzolo et al. | |
| 8,449,137 | B2 | 5/2013 | Dassanayake et al. | |
| 8,482,212 | B1 | 7/2013 | Ivey et al. | |
| 8,573,813 | B2 | 11/2013 | Ivey et al. | |
| 8,596,813 | B2 | 12/2013 | Ivey | |
| 2002/0060526 | A1 | 5/2002 | Timmermans et al. | |
| 2003/0007348 | A1 | 1/2003 | Loga et al. | |
| 2004/0001344 | A1 | 1/2004 | Hecht | |
| 2004/0233664 | A1* | 11/2004 | Beeson et al. | 362/231 |
| 2006/0203468 | A1 | 9/2006 | Beeson et al. | |
| 2007/0297179 | A1 | 12/2007 | Leung et al. | |
| 2008/0198572 | A1* | 8/2008 | Medendorp | 362/84 |
| 2010/0067241 | A1* | 3/2010 | Lapatovich et al. | 362/361 |
| 2010/0172152 | A1* | 7/2010 | Boonekamp | 362/609 |
| 2010/0271843 | A1* | 10/2010 | Holten et al. | 362/609 |
| 2011/0156072 | A1* | 6/2011 | Ling | 257/98 |
| 2012/0051041 | A1* | 3/2012 | Edmond et al. | 362/231 |

FOREIGN PATENT DOCUMENTS

| | | | |
|---|---|---|---|
| WO | 2010099755 | A1 | 9/2010 |
| WO | 2010128438 | A1 | 11/2010 |

OTHER PUBLICATIONS

U.S. Appl. No. 29/368,970, filed Aug. 31, 2010.
U.S. Appl. No. 12/961,385, filed Dec. 6, 2010.
Cree, Inc., International Patent Application No. PCT/US2012/032855, International Search Report and Written Opinion, Oct. 15, 2012.
U.S. Appl. No. 29/467,949, filed Sep. 25, 2013.
U.S. Appl. No. 13/943,152, filed Jul. 16, 2013.

* cited by examiner

LED LUMINAIRE INCLUDING A THIN PHOSPHOR LAYER APPLIED TO A REMOTE REFLECTOR

BACKGROUND

Light emitting diode (LED) lighting systems are becoming more prevalent as replacements for existing lighting systems. LEDs are an example of solid state lighting (SSL) and have advantages over traditional lighting solutions such as incandescent and fluorescent lighting because they use less energy, are more durable, operate longer, can be combined in red-blue-green arrays that can be controlled to deliver virtually any color light, and contain no lead or mercury. In many applications, one or more LED dies (or chips) are mounted within an LED package or on an LED module, which may make up part of a lighting unit, lamp, "light bulb" or more simply a "bulb," which includes one or more power supplies to power the LEDs. An LED bulb may be made with a form factor that allows it to replace a standard threaded incandescent bulb, or any of various types of fluorescent lamps. LEDs can also be used in place of florescent lights as backlights for displays.

Color reproduction can be an important characteristic of any type of artificial lighting, including LED lighting. For lamps, color reproduction is typically measured using the color rendering index (CRI). The CRI is a relative measurement of how the color rendition of an illumination system compares to that of a particular known source of light. In more practical terms, the CRI is a relative measure of the shift in surface color of an object when lit by a particular lamp. The CRI equals 100 if the color coordinates of a set of test surfaces being illuminated by the lamp are the same as the coordinates of the same test surfaces being irradiated by the known source. CRI is a standard for a given type light or light from a specified type of source with a given color temperature. A higher CRI is desirable for any type of replacement lamp.

To achieve accurate color, wavelength conversion material is sometimes used in lighting systems. The wavelength conversion materials may produce white light when struck by light of a specified color, or may produce an additional color of light that mixes with other colors of light to produce white light, or another specific desired color of light. As an example, phosphor particles can be used as a wavelength conversion material. Phosphor absorbs light at one wavelength and re-emits light at a different wavelength. Typically, phosphor particles are randomly distributed within the matrix of encapsulant material. The term phosphor can refer to materials that are sometimes also referred to as fluorescent and/or phosphorescent. Most phosphors absorb light having low wavelengths and re-emit light having longer wavelengths.

SUMMARY

Embodiments of the invention provide for a solid state luminaire or light fixture using GaN-based LEDs, for example, LEDs with an InGaN active layer. The LEDs ultimately illuminate and activate a thin or dilute remote phosphor coating applied to a reflective substrate formed to act as a reflector for the fixture. Using a thinner or more dilute layer of remote phosphor can reduce phosphor cost. In some embodiments, the GaN LEDs are also packaged with a phosphor so that less intense blues are produced by the LED devices. In some embodiments, GaN LED devices are used exclusively, so that the luminaire does not need to be engineered to take into account the different thermal profiles and colors of GaN and GaP LEDs, the latter of which typically produces red light. Thus, in some embodiments of the invention a lighting system is provided where an LED light source and a remote phosphor are selected and positioned to provide indirect light as substantially white light.

In some embodiments, the luminaire includes an LED light source and a reflector disposed to reflect light from the LED light source and direct light out of the luminaire to provide illumination. A thin or dilute layer of phosphor is applied to the reflector to provide wavelength conversion for at least a portion of the light from the light source. The luminaire emits substantially white light. In some embodiments, the LED light source includes at least one LED with a GaN emitting layer.

In some embodiments, the phosphor layer on the reflector is between 5 and 50 μm thick. In some embodiments, the phosphor layer is between 5 and 25 μm thick. In some embodiments, the LEDs with the GaN emitting layer are packaged with a local phosphor as blue-shifted yellow (BSY), blue-shifted green (BSG), blue-shifted red (BSR) or cyan-shifted red (CSR) LED devices. LEDs emitting a specific color without local phosphor can also be used. In some embodiments LEDs emitting blue, royal blue or cyan light can be included in the luminaire. In some embodiments, the phosphor includes red, red/orange, yellow, green or cyan emitting phosphor. In some embodiments, the phosphor includes at least two, different color emitting phosphors.

A luminaire according to embodiments of the invention can take many different forms. In some embodiments, the luminaire is a light fixture using a plurality of GaN-based LED devices as the light source. The LED devices can be positioned on a mounting surface of a heatsink, wherein the mounting surface is positioned opposite a reflector with the phosphor applied. In some embodiments, the reflector includes two parabolic regions. In some embodiments, the reflector has a flat region opposite the mounting surface of the heatsink. In some embodiments, the fixture includes a diffuser lens assembly.

This diffuser lens assembly can include two lens plates disposed at the sides of the heatsink. In some embodiments, the fixture includes a pan to support the fixture when mounted in a ceiling. The light fixture can be assembled by providing a housing including the reflector and then coating the reflector with a phosphor to the desired thickness. The light source and heatsink assembly are positioned so that light from the GaN LED light source impinges on the reflector with the phosphor. The diffuser assembly can be positioned adjacent to the heatsink so that light from the GaN LED light source and the phosphor leaves the light fixture through the diffuser lens assembly.

BRIEF DESCRIPTION OF THE DRAWINGS

FIG. 3 presents various views as FIGS. 3A, 3B, 3C and 3D.

DETAILED DESCRIPTION

Figure 1:
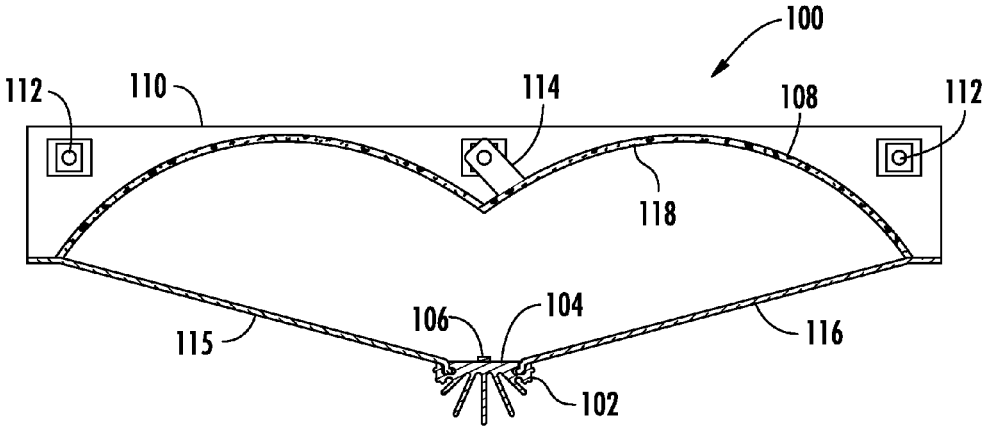
FIG. 1 is a cross-sectional view of a light engine for a light fixture according to an example embodiment of the present invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

As previously mentioned, embodiments of the invention provide for a solid state luminaire or light fixture using GaN-based LEDs. The LEDs ultimately illuminate and activate a thin or dilute remote phosphor coating applied to a reflective substrate formed to act as a reflector for the fixture. Using a thinner or more dilute layer of remote phosphor can reduce phosphor cost. The GaN LEDs can also be packaged with a phosphor so that less intense blues are produced. If GaN LED devices are used exclusively, the luminaire does not need to be engineered to take into account the different thermal profiles and colors of GaN and GaP LEDs, the latter of which typically produce red light.

As examples of embodiments of the invention described herein, a lighting system is shown as a light engine for a troffer-style light fixture. The lighting system includes the remote reflector with a phosphor layer applied as well as the LED light source. The troffer-style light fixture is shown as an example luminaire. Such a luminaire might be used as a solid-state replacement for a standard fluorescent light fixture, and/or might be of a form factor to be placed in the space normally occupied by a drop ceiling tile in an office environment. Various combinations of LEDs and phosphors will be discussed. Any of these, and others, can be used to produce substantially white light from the system. It cannot be overemphasized that all of these detailed embodiments are provided as examples only, and that a luminaire, lighting system or fixture that implements an embodiment of the invention can take many forms and be made in many ways. An embodiment of the invention can be developed based on the disclosure herein for any type of directional solid-state lighting. For example, an embodiment of the invention could be used to create a solid-state replacement for a standard R30 incandescent bulb that is commonly used in residential down-lighting.

FIG. 1 is a cross-sectional view a light engine 100 according to example embodiments of the invention. Light engine 100 includes heatsink 102 having a mounting surface 104 on which light sources can be mounted. In this example, LED packages 106 serve as light sources. The light sources can be mounted flat to the surface 104 to face the reflector 108, which is installed in the top of housing 110. Reflector 108 may be designed to have any of various shapes to perform particular optical functions, such as color mixing and beam shaping, for example. In the example of FIG. 1, reflector 108 includes two curved side regions. More particularly in this example, the side regions are parabolic. Other mechanical features of light engine 100 include mounting holes 112 in housing 110, as well as strap 114 which supports reflector 108 at what is in this view the back of the housing. The front of the housing has a similar strap (not visible) connected to the other side region of reflector 108. Light engine 100 also includes a diffuser lens assembly made up of two lens plates, 115 and 116, disposed at the sides of the heatsink.

Still referring to FIG. 1, the housing 110 can be made of any of various materials including metal such as steel or aluminum, and plastic. Reflector 108 can be made of many different materials, including metal with a specular surface or a white reflector such as a microcellular polyethyleneterephthalate (MCPET) for example. Other white reflective materials can also be used. In either case, reflector 108 is coated with a thin layer of phosphor 118. The thickness of the phosphor in this and the other diagrams in this present application is not to scale and is exaggerated for clarity. The thin layer can be applied to the reflector, for example, by using a dilute phosphor mixture, that is, a mixture with a relatively small number of phosphor particles distributed in the encapsulant material. In some embodiments the phosphor layer is less than 50 μm thick. In some embodiments the phosphor layer is less than 25 μm thick. In some embodiments, the phosphor layer may be at least 5 μm thick or at least 10 μm thick.

In a light engine like that of FIG. 1, as well as in other embodiments, various combinations of colors can be used for both the color emitted by the LED packages and the color emitted by the phosphor. As one example, blue-shifted yellow (BSY) LED devices can be used as the light source, and red-emitting phosphor can be used on the reflector. For example, in some embodiments, the phosphor layer on the reflector, when energized, emits light having dominant wavelength from 600 to 640 nm, or 605 to 630 nm, which in either case may be referred to as "red" light. The LEDs in the BSY LED packages that serve as the light source, when illuminated, emit light having a dominant wavelength from 435 to 490 nm, 440 to 480 nm, or 445 to 465 nm. The phosphor in the BSY LED packages emits light having a dominant wavelength from 540 to 585 nm, or 560 to 580 nm. These combinations of lighting elements can be referred to as a "blue-shifted yellow plus red" (BSY+R) system. This is but one example of a combination of lighting elements and phosphor that can be used to create substantially white light with a color rendering index (CRI) at least as good as generated by relatively low CRI types of residential lighting. Embodiments of the invention can produce light with a CRI of at least 70, at least 80, at least 90, or at least 95. Further examples and details of mixing colors of light using solid state emitters and phosphor can be found in U.S. Pat. No. 7,213,940, which is incorporated herein by reference.

To further explain what is meant herein by "substantially white" light, the color of light can be indicated in a chromaticity diagram, such as the 1931 CIE Chromaticity Diagram. Such a diagram includes a blackbody locus of points, which indicates points in the color space for light that humans perceive as the same or close to natural sources of light. A good "white" light source is generally considered a source whose point in the color space falls within four MacAdam ellipses of any point in the blackbody locus of points. In some embodiments of the present invention, this distance can be achieved. However, if the point for the light from a luminaire according to embodiments of the invention falls within six MacAdam ellipses in some embodiments or ten MacAdam ellipses in some embodiments, such light would be considered substantially white light for purposes of this disclosure. Further discussion of CIE diagrams and the blackbody locus of points can be found in U.S. Pat. No. 7,768,192, which is incorporated herein by reference.

Figure 2:
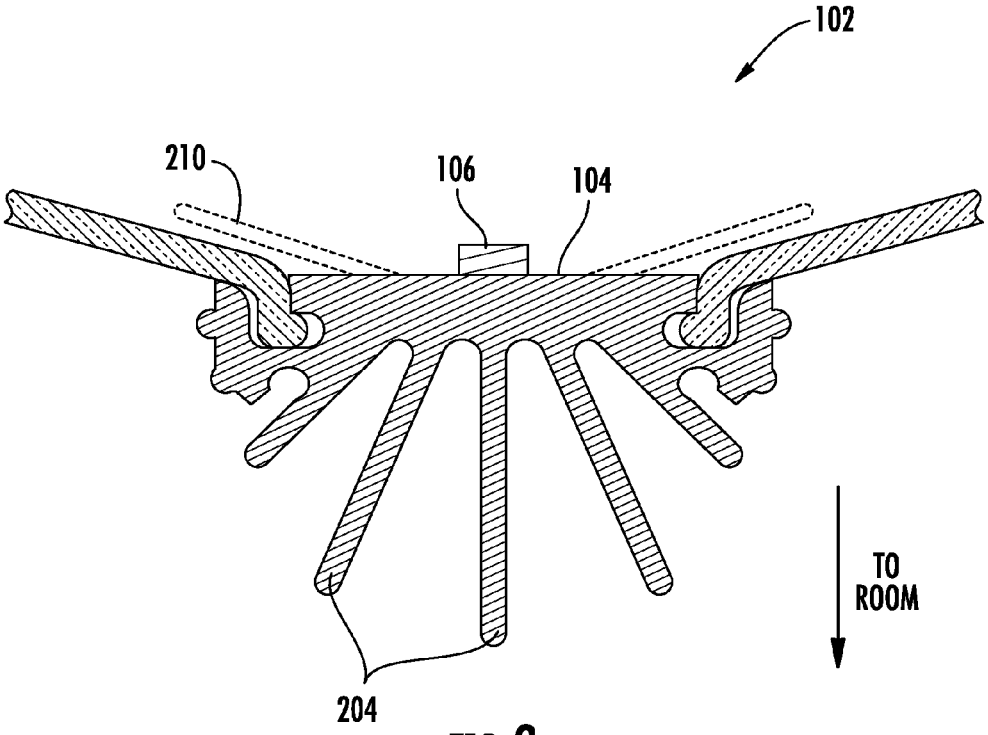
FIG. 2 is a cross-sectional view of the heatsink and light source for the light engine of FIG. 1.

FIG. 2 is a close-up, cross-sectional view of the heatsink area of example light engine 100 of FIG. 1, in which the heatsink and light source of visible in some detail. It should be understood that FIG. 2 provides an example only as many different heatsink structures could be used with an embodiment of the present invention. The orientation of the heatsink relative to a room being illuminated is indicated. The top side portion of the heatsink 102 faces the interior cavity of the light engine. Heatsink 102 includes fin structures 204 and mounting surface 104. The mounting surface 104 provides a substantially flat area on which LED packages 106 can be mounted for use as a light source. The LED packages 106 can be mounted to face orthogonally to the mounting surface 104 to face the center region of the phosphor-coated reflector, or they may be angled to face other portions of the reflector. In some embodiments, an optional baffle 210 (shown in dotted lines) may be included. The baffle 210 reduces the amount of light emitted from the sources 106 at high angles that escapes the cavity without being reflected. Such baffling can help prevent visible hot spots or color spots at high viewing angles.

FIG. 3 presents various views of an example light fixture that makes use of an embodiment of the invention. Troffer fixture 300 makes use of the light engine of FIG. 1, and is illustrated in FIG. 3 by way of various views shown in FIGS. 3A, 3B, 3C and 3D. FIG. 3A is a cross-sectional view of the troffer 300 according to an example embodiment of the present invention. Because such light fixtures are traditionally used in large areas populated with modular furniture, such as in an office for example, many fixtures can be seen from anywhere in the room. Specification grade fixtures often include mechanical shielding in order to effectively hide the light source from the observer once he or she is a certain distance from the fixture, providing a "quiet ceiling" and a more comfortable work environment. Pan 302 of troffer fixture 300 is typically of a size and shape to provide a primary cutoff of the light coming through lens plates 115 and 116 to provide such mechanical shielding, while also providing mechanical support for the light engine. Heatsink 102 can be made adjustable to provide the desired shielding without the constraint of thermal surface area requirements.

Figure 3A:
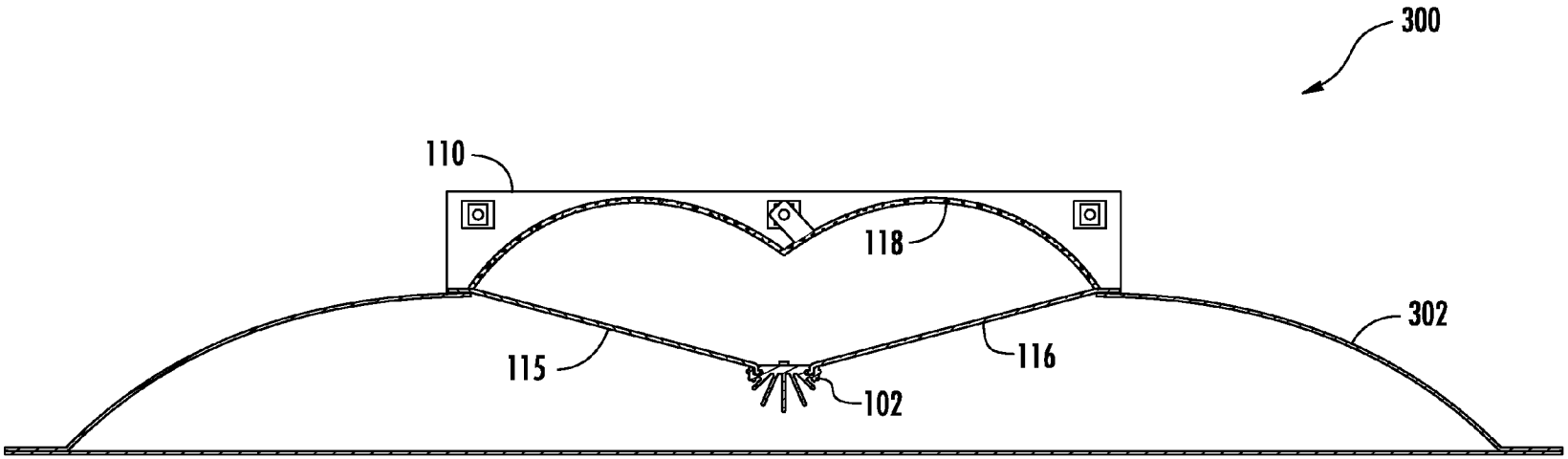
FIG. 3 shows several views of a light fixture making use of the light engine of FIG. 1.
Figure 3B:
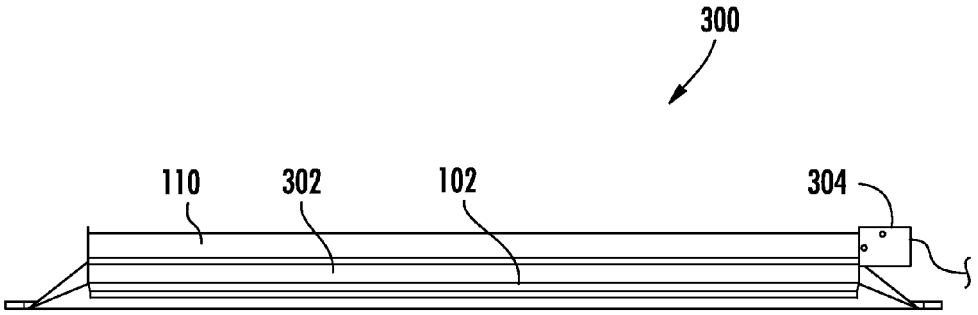
Figure 3C:
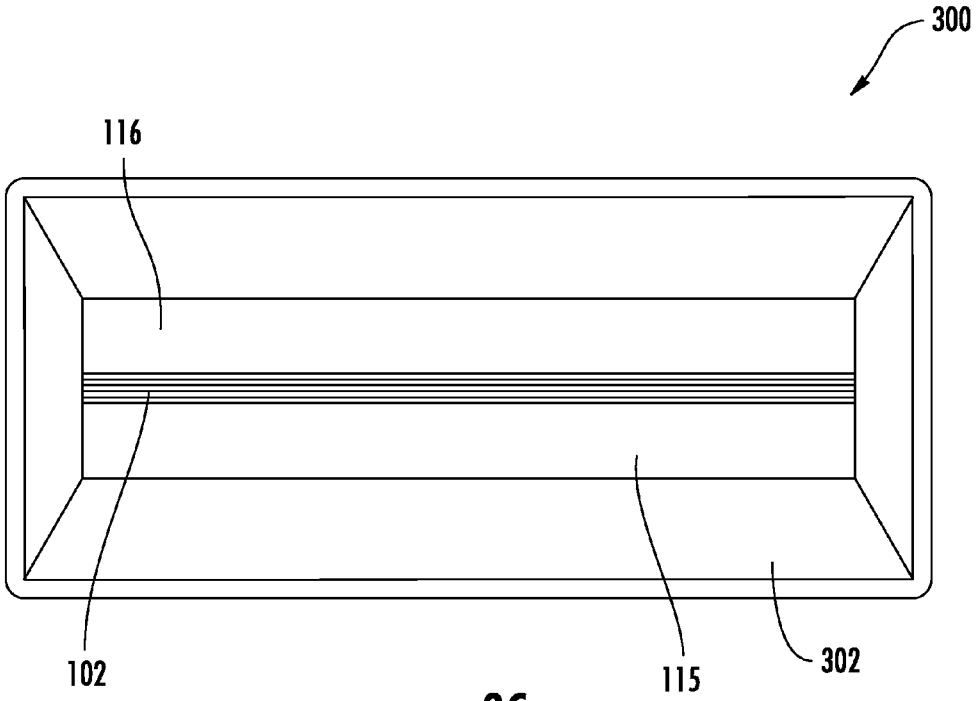
Figure 3D:
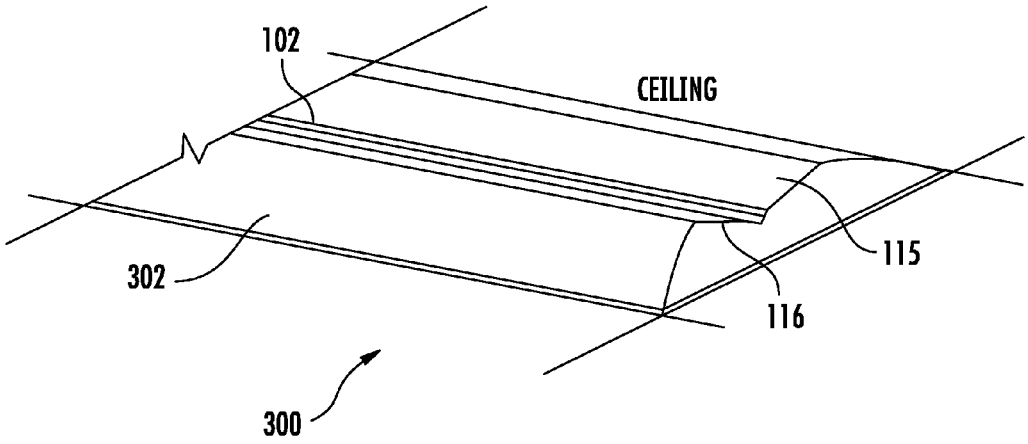

FIG. 3B is a cutaway side view of troffer fixture 300, and FIG. 3C is a bottom view of troffer fixture 300. Circuit box 304 is attached to the backside of the light engine. Circuit box 304 houses electronics used to drive and control the light sources such as rectifiers, regulators, timing circuitry, and other components. Wiring from the circuit box to the light sources can be passed through holes or slots in heat sink 102. FIG. 3D is a perspective view of troffer fixture 300 mounted in a typical office ceiling. In this view, as in the bottom view of FIG. 3C, the reflector is occluded from view by the lens plates 115 and 116 and the heatsink 102. The bottom side of the heatsink 102 is exposed to the room environment. Pan 302 is sized to fit around the light engine and within a space of one or two ceiling tiles of a typical office drop ceiling.

Figure 4:
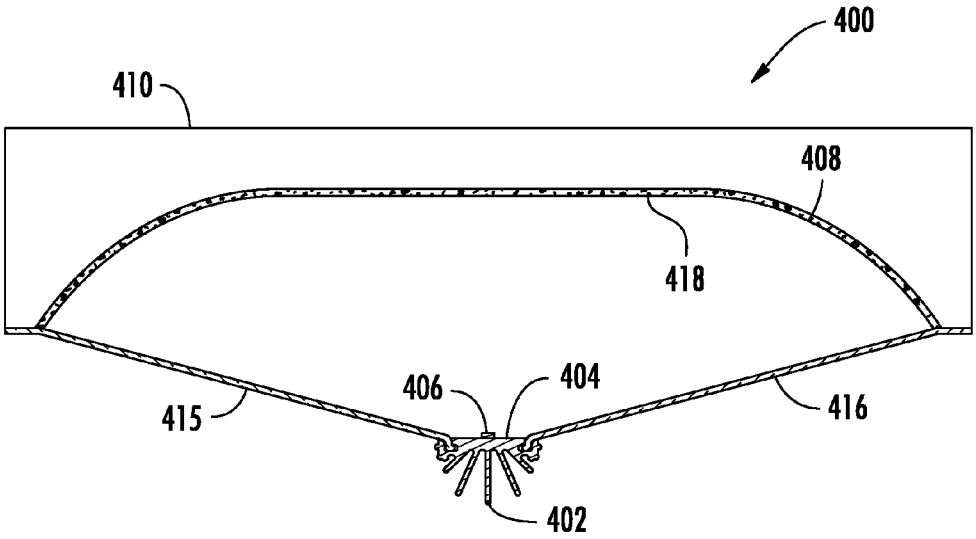
FIG. 4 is a cross-sectional view of a light engine for a light fixture according to another example embodiment of the present invention.

FIG. 4 is a cross-sectional diagram of a light engine 400 according to another embodiment of the invention. Light engine 400 could be used, as an example, in a troffer style fixture as an alternative to light engine 100 previously discussed. Light engine 400 includes heatsink 402 having a mounting surface 404 on which light sources can be mounted. In this example, LED packages 406 serve as light sources. The light sources can be mounted flat to the surface 404 to face the reflector 408, which is installed in the top of housing 410. In the example of FIG. 4, reflector 408 does not have two distinct side regions, but rather a flat region opposite the mounting surface of the heatsink. Light engine 400 also includes a diffuser lens assembly made up of two lens plates, 415 and 416, disposed at the sides of the heatsink.

Still referring to FIG. 4, the housing 410 can be made of any of various materials including metal such as steel or aluminum, and plastic. Reflector 408 can be made of many different materials, including metal with a specular surface or a white reflector such as a microcellular polyethyleneterephthalate (MCPET) for example. Other white reflective materials can also be used. Reflector 408 is coated with a thin layer of phosphor 418. The thickness of the phosphor in this diagram is not to scale and is exaggerated for clarity. As before, in some embodiments the phosphor layer is less than 50 μm thick. In some embodiments the phosphor layer is less than 25 μm thick. In some embodiments, the phosphor layer may be at least 5 μm thick or at least 10 μm thick.

In a light engine like that of FIG. 4, like in the case of the light engine of FIG. 1, various combinations of colors can be used for both the color emitted by the LED packages and the color emitted by the phosphor. As one example, blue-shifted yellow (BSY) LED devices can be used as the light source, and red-emitting phosphor can be used on the reflector. In some embodiments, the phosphor layer on the reflector, when energized, emits light having dominant wavelength from 600 to 640 nm, or 605 to 630 nm, which in either case may be referred to as "red" light. The LEDs in the BSY LED packages that serve as the light source, when illuminated, emit light having a dominant wavelength from 435 to 490 nm, 440 to 480 nm, or 445 to 465 nm. The phosphor in the BSY LED packages emits light having a dominant wavelength from 540 to 585 nm, or 560 to 580 nm. These combinations of lighting elements can be referred to as a "blue-shifted yellow plus red" (BSY+R) system. This is but one example of a combination of lighting elements and phosphor that can be used to create substantially white light as previously described.

In addition to the blue-shifted yellow plus red (BSY+R) system already discussed, other combinations of LEDs and phosphor can be used to implement an embodiment of the invention, and produce substantially white light. Other colors of light can be produced as well. LED packages can be used to emit blue-shifted green (BSG) light by using a blue LED as already described with a phosphor emitting green light, that is, a phosphor emitting light with a wavelength in the range of 510-550 nm. A red-emitting phosphor can be packaged with such an LED to form a blue-shifted red (BSR) light source. A red-emitting phosphor can be packaged with a cyan emitting LED as the light source. The cyan emitting LED structure emits light in the wavelength range of 480 to 510 nm, or 487 to 505 nm. Such a light source can be considered a cyan-shifted red (CSR) light source. A royal blue emitting LED can be added to the system, packaged either alone or with a phosphor. A royal blue LED emits light having a wavelength in the upper portion of the wider blue wavelength ranges already discussed, or from about 466 to 486 nm. Appropriate adjustments to the phosphor on the reflector of the light engine of an embodiment of the present invention are made depending on the type of LEDs used, whether they are packaged with a phosphor, and the wavelength emitted by both phosphors.

In addition to color combinations already discussed, some example combinations of LEDs with and without local phosphors and specified color-emitting phosphors for the reflector for a light engine according to embodiments of the invention will now be described. The red remote phosphor already described with BSY LED packages can also be used with BSY and cyan LED packages, or BSY and royal blue LED packages, where the cyan and royal blue LEDs are packaged without a local phosphor. A red and spatially separated cyan phosphor or a red and spatially separated green phosphor can be used on the reflector with BSY LED devices. Where spatially separated different color phosphors are used, they can be applied to the reflector in any of various patterns, including alternating stripes, in a pixilated pattern, or in alternating blocks.

BSG devices can be used alone as a light source with a red/orange remote phosphor on the reflector, or can be combined with either royal blue or cyan LED devices and used with the red/orange remote phosphor. A BSG light source can also be used with a reflector including red/orange and a spatially separated cyan or yellow phosphor. BSR devices can be used alone as a light source with a yellow remote phosphor on the reflector, or can be combined with either royal blue or cyan LED devices and used with the yellow remote phosphor. A BSR light source can also be used with a reflector including yellow and a spatially separated cyan or green phosphor. CSR devices can be used alone as a light source with a yellow remote phosphor on the reflector, or can be combined with either royal blue or cyan LED devices and used with the yellow remote phosphor. CSR and blue devices can be used with a reflector including yellow and a spatially separated green phosphor.

A light source used with example embodiments of the invention can also used multiple types of devices packaged with local phosphors. For example, BSY and CSR LED devices can be used together with a green-emitting phosphor on the reflector, as can BSY and BSR devices. BSY and BSR devices can also be used with cyan phosphor on the reflector, or with spatially separated cyan and green phosphors on the reflector. Additionally, mixed phosphors on the reflector need not be spatially separated. Phosphors emitting two or more different colors can simply be mixed together to produce a desired color profile. A luminaire can also be produced using only specific color-emitting LEDs packaged without local phosphor so that most of the light from the active layers of the LEDs directly energizes the phosphor(s) on the reflector, with the colors all tuned to produce a desired color of light using the indirect light of the LEDs. As an example, blue emitting LEDs could be used as the light source and a mixture of red and green phosphor can be used on the reflector to produce substantially white light as previously described.

The combinations of LED devices with phosphorized reflectors given as examples above can be used to create various colors of light, including substantially white light with a color rendering index (CRI) at least as good as generated by relatively low CRI types of residential lighting. Example embodiments can produce light with a CRI of at least 70, at least 80, at least 90, or at least 95. Again, by use of the term substantially white light, one could be referring to a chromacity diagram including a blackbody locus of points, where the point for the source falls within four or six or ten MacAdam ellipses of any point in the blackbody locus of points.

Embodiments of the invention can use varied fastening methods and mechanisms for interconnecting the parts of the lighting system and luminaire. For example, in some embodiments locking tabs and holes can be used. In some embodiments, combinations of fasteners such as tabs, latches or other suitable fastening arrangements and combinations of fasteners can be used which would not require adhesives or screws. In other embodiments, adhesives, screws, bolts, or other fasteners may be used to fasten together the various components.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A troffer comprising:

a reflector disposed to reflect light and direct light out of the troffer to provide illumination;

a plurality of LEDs to produce the light, the plurality of LEDs mounted on a surface to face the reflector;

a diffuser lens assembly disposed at the sides of the surface; and a layer of phosphor between 5 and 50 μm thick applied to the reflector to provide wavelength conversion for at least a portion of the light from the light source;

wherein the surface faces a center region of the reflector to which the layer of phosphor is applied so that the troffer emits light through the diffuser lens assembly.

2. The troffer of claim 1 wherein the plurality of LEDs further comprises at least one LED with a GaN emitting layer.

3. The troffer of claim 2 wherein the layer of phosphor is between 5 and 25 μm thick.

4. The troffer of claim 2 wherein the plurality of LEDs comprise at least a first LED that is packaged as at least one of blue-shifted yellow (BSY), blue-shifted green (BSG), blue-shifted red (BSR), blue, and cyan-shifted red (CSR) LED devices.

5. The troffer of claim 4 wherein the layer of phosphor includes at least one of red, red/orange, yellow, green and cyan emitting phosphor so that the light emitted through the diffuser lens assembly comprises substantially white light.

6. The troffer of claim 5 further comprising:

a pan surrounding the diffuser lens assembly to support the troffer when mounted in a ceiling.

7. The troffer of claim 6 wherein the layer of phosphor includes at least two, different color emitting phosphors.

8. The troffer of claim 4 wherein the plurality of LEDs further comprises at least a second LED that emits one of blue, royal blue and cyan light.

9. The troffer of claim 8 wherein the layer of phosphor includes at least one of red, red/orange, yellow, green and cyan emitting phosphor.

10. The troffer of claim 9 further comprising:

a pan surrounding the diffuser lens assembly to support the troffer when mounted in a ceiling.

11. The troffer of claim 10 wherein the layer of phosphor includes at least two, different color emitting phosphors.

12. A light fixture comprising:

a reflector disposed to reflect light and direct light out of the light fixture;

a plurality of GaN LED devices to produce the light, at least some of the plurality of GaN devices mounted on a surface to face the reflector;

a phosphor applied to the reflector to provide wavelength conversion for at least a portion of the light from the plurality of GaN LED devices; and a diffuser lens assembly through which light exits the light fixture, the diffuser lens assembly disposed at the sides of the surface;

wherein the surface faces a center region of the reflector to which the phosphor is applied so that the light fixture emits light through the diffuser lens assembly.

13. The light fixture of claim 12 wherein the plurality of GaN LED devices comprises at least a first LED that is one of a blue-shifted yellow (BSY), blue-shifted green (BSG), blue-shifted red (BSR), blue and cyan-shifted red (CSR) LED device so that the light emitted through the diffuser lens assembly comprises substantially white light.

14. The light fixture of claim 13 wherein the phosphor includes at least one of red, red/orange, yellow, green and cyan emitting phosphor.

15. The luminaire of claim 14 wherein the thin layer of phosphor includes at least two, different color emitting phosphors.

16. The light fixture of claim 14 further comprising a heatsink on which the GaN LED devices are mounted.

17. The light fixture of claim 16 wherein the diffuser lens assembly comprises two lens plates.

18. The light fixture of claim 17 wherein the reflector comprises two parabolic regions.

19. The light fixture of claim 17 wherein the reflector comprises a flat region opposite the heatsink.

20. The light fixture of claim 14 wherein the plurality of GaN LED devices further comprise at least a second LED device that emits one of blue, royal blue and cyan light.

21. The light fixture of claim 20 further comprising a heatsink on which the GaN LED devices are mounted.

22. The light fixture of claim 21 wherein the diffuser lens assembly comprises two lens plates disposed at the sides of the heatsink.

23. The light fixture of claim 22 wherein the reflector comprises two parabolic regions.

24. The light fixture of claim 22 wherein the reflector comprises a flat region opposite the mounting surface of the heatsink.

25. A method of assembling a light fixture, the method comprising:

providing a housing including a reflector;

coating the reflector with a phosphor to a thickness of from 5 to 50 μm;

installing a plurality of GaN LEDs on a mounting surface of a heatsink wherein the mounting surface faces a center region of the reflector coated with the phosphor so that light from the plurality of GaN LEDs impinges on the reflector with the phosphor; and positioning a diffuser lens assembly adjacent to the heatsink so that light from the plurality of GaN LEDs is reflected from the reflector with the phosphor and leaves the light fixture through the diffuser lens assembly.

26. The method of claim 25 wherein the reflector is coated with phosphor to a thickness of from 5 to 25 μm.

27. The method of claim 25 further comprising connecting a pan to the housing in order to support the light fixture when mounted in a ceiling.

28. The method of claim 27 wherein the positioning of the diffuser includes positioning two lens plates at the sides of the heatsink.

29. The method of claim 26 further comprising connecting a pan to the housing in order to support the light fixture when mounted in a ceiling.

30. The method of claim 29 wherein the positioning of the diffuser includes positioning two lens plates at the sides of the heatsink.

31. A lighting system comprising:

an LED on a mounting surface; and a layer of remote phosphor between 5 and 50 μm thick;

wherein the LED and the remote phosphor are selected and positioned with the mounting surface facing a central region of the remote phosphor so that indirect light is provided and is emitted from the lighting system through a diffuser lens assembly disposed at the sides of the mounting surface adjacent to the LED.

32. The lighting system of claim 31 wherein the remote phosphor is applied to a reflector disposed to reflect the light from the LED through the diffuser lens assembly.

33. The lighting system of claim 32 wherein the LED further comprises at least one LED with a GaN emitting layer.

34. The lighting system of claim 33 wherein the remote phosphor is between 5 and 25 μm thick.

35. The lighting system of claim 33 wherein the remote phosphor comprises at least two, different color emitting phosphors so that the light emitted through the diffuser lens assembly comprises substantially white light.

* * * * *